US006167229A

United States Patent [19]

Watanabe et al.

[11] Patent Number: 6,167,229

[45] **Date of Patent: *Dec. 26, 2000**

[54] IMAGE FORMING APPARATUS FOR ENABLING EASY SEPARATION OF RECORDING SHEETS FROM PHOTOSENSITIVE MEMBER

[75] Inventors: Takeshi Watanabe, Ichikawa; Takao Izumi, Yokohama, both of Japan

[73] Assignee: Kabushiki Kaisha Toshiba, Kawasaki, Japan

[ * ] Notice: This patent is subject to a terminal disclaimer.

[21] Appl. No.: 09/432,598

[22] Filed: Nov. 3, 1999

Related U.S. Application Data

[63] Continuation of application No. 09/104,364, Jun. 25, 1998, Pat. No. 6,044,244.

[30] Foreign Application Priority Data

Jul. 15, 1997 [JP] Japan ..... 9-190120

[51] Int. Cl.[7] ..... G03G 15/16

[52] U.S. Cl. ..... 399/313; 399/312

[58] Field of Search ..... 399/299, 303, 399/312, 313, 314, 297, 302; 430/126

[56] References Cited

U.S. PATENT DOCUMENTS

| | | | |
|---|---|---|---|
| 4,274,361 | 6/1981 | Sanders et al. | 399/313 |
| 4,998,143 | 3/1991 | Kumasaka et al. | 355/271 |
| 5,089,855 | 2/1992 | Mochimaru | 355/271 |
| 5,172,173 | 12/1992 | Goto et al. | 355/275 |
| 5,191,378 | 3/1993 | Itaya et al. | 399/313 |
| 5,195,430 | 3/1993 | Rise | 100/168 |
| 5,386,274 | 1/1995 | Sanpe et al. | 399/101 |
| 5,469,248 | 11/1995 | Fujiwara et al. | 355/326 |
| 5,666,622 | 9/1997 | Harasawa et al. | 399/313 |
| 5,669,054 | 9/1997 | Uchida et al. | 399/313 |
| 5,678,149 | 10/1997 | Takekoshi et al. | 399/299 |
| 5,923,937 | 7/1999 | Thompson et al. | 399/302 |
| 5,978,617 | 11/1999 | Takano et al. | 399/61 |
| 6,075,965 | 7/1999 | Tombs et al. | 399/308 |

FOREIGN PATENT DOCUMENTS

| | | |
|---|---|---|
| 0712054 | 5/1996 | European Pat. Off. . |
| 3-62071 | 3/1991 | Japan . |
| 5-107952 | 4/1993 | Japan . |
| 7-168458 | 7/1995 | Japan . |
| 9-127744 | 5/1997 | Japan . |

*Primary Examiner*—Arthur T. Grimley
*Assistant Examiner*—Hoang Ngo
*Attorney, Agent, or Firm*—Foley & Lardner

[57] ABSTRACT

A copying machine is provided with a transfer belt which is in contact with the surface of a photosensitive drum and which is made to run in an endless manner. A transfer roller and an auxiliary roller are arranged inside the region defined by the transfer belt. The transfer roller is in contact with the transfer belt, defining a transfer nip therebetween. The transfer nip is part of a conveyance nip defined between the drum surface and the transfer belt, and is located downstream of the region just under the photosensitive drum. The auxiliary roller is located downstream of the conveyance nip. The contact between the drum surface and the transfer belt defines a posterior-transfer conveyance nip located downstream of the transfer nip with respect to the running direction of the transfer belt, and also defines a prior-transfer conveyance nip located upstream of the transfer nip with respect to the same direction. The width of the posterior-transfer conveyance nip is less than that of the prior-transfer conveyance nip. With this structure, satisfactory transfer characteristics are maintained, and yet the separation characteristics of recording sheets with reference to the drum surface can be improved. Accordingly, images of good quality can be output.

5 Claims, 16 Drawing Sheets

| A(mm) | C(mm) | B(mm) | HALFTONE | SEPARATION CHARACTERISTICS |
|---|---|---|---|---|
| 2 | 0.5 | 7.5 | POCK-LIKE MARKS PRODUCED | DEFECTIVE SEPARATION IN HUMID ENVIRONMENT |
| 2 | 2 | 6 | POCK-LIKE MARKS PRODUCED | SAME AS ABOVE |
| 2 | 4 | 4 | ○ | DEFECTIVE SEPARATION OCCURS OCCASIONALLY |
| 2 | 6 | 2 | ○ | ○ |
| 2 | 7.5 | 0.5 | ○ | ○ |
| 4 | 0.5 | 5.5 | POCK-LIKE MARKS PRODUCED | DEFECTIVE SEPARATION IN HUMID ENVIRONMENT |
| 4 | 2 | 4 | POCK-LIKE MARKS PRODUCED | SAME AS ABOVE |
| 4 | 3 | 3 | ○ | DEFECTIVE SEPARATION OCCURS OCCASIONALLY |
| 4 | 4 | 2 | ○ | ○ |
| 4 | 5.5 | 0.5 | ○ | ○ |

FIG. 3

| | WIDTHS OF NIPS "18" AND "19" | MISSING IMAGE PORTIONS PRODUCED | IMAGE BLURRING | IRREGULAR DISCHARGE |
|---|---|---|---|---|
| TRANSFER ROLLER | 0mm | ◎ VERY RELIABLE | ◎ VERY RELIABLE | ◎ VERY RELIABLE |
| | LESS THAN 1mm | ○ | ○ | ○ |
| | 1 TO 2mm | ○ | △ SLIGHTLY BLURRED | ○ |
| | 2 TO 3mm | ○ | △ | ○ |
| | 3 TO 5mm | × MISSING IMAGE PORTIONS PRODUCED | × MARKED IMAGE BLURRING | ○ |
| | 5mm OR MORE | × | × | |
| TRANSFER BRUSH | -5mm | ○ GOOD | ○ GOOD | △ DISCHARGE OCCURS SLIGHTLY |
| | -1 TO -3mm | ○ | ○ | △ |
| | -1 TO 0mm | ○ | ○ | ○ ALMOST RELIABLE |
| | 0mm | ◎ VERY RELIABLE | ◎ VERY RELIABLE | ◎ VERY RELIABLE |
| | LESS THAN 1mm | ○ | ○ | ○ |
| | 1 TO 2mm | ○ | △ SLIGHTLY BLURRED | ○ |

FIG. 10

| RUNNING TEST CONDITIONS | RESULTS OF RUNNING TEST |
|---|---|
| MOVE UNIT ABOUT 10mm EACH TIME 100 K SHEETS ARE FED | BELT DOES NOT PEEL OFF EVEN AFTER FEEDING OF 600 K SHEETS |
| MOVE UNIT ABOUT 3mm EACH TIME 100 K SHEETS ARE FED | SAME AS ABOVE |

| | | TRANSFER NIP | | | |
|---|---|---|---|---|---|
| | | 1mm | 2mm | 3mm | 4mm |
| PRIOR-TRANSFER CONVEYANCE NIP | -1mm | ×IRREGULAR DISCHARGE | ×IRREGULAR DISCHARGE | ×IRREGULAR DISCHARGE | ×IRREGULAR DISCHARGE |
| | 0mm | △IRREGULAR DISCHARGE | △IRREGULAR DISCHARGE | △IRREGULAR DISCHARGE | △IRREGULAR DISCHARGE |
| | 1mm | △DEFECTIVE TRANSFER | ○ | ○ | ○ |
| | 2mm | △NON-UNIFORM TRANSFER | ○ | ○ | ○ |
| | 3mm | △NON-UNIFORM TRANSFER | ○ | ○ | ○ |

FIG. 12

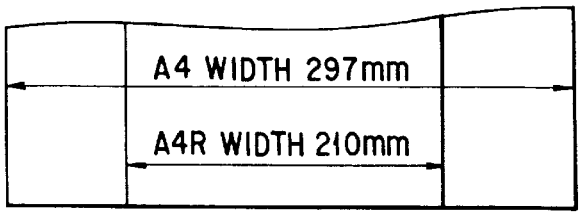
FIG. 19A
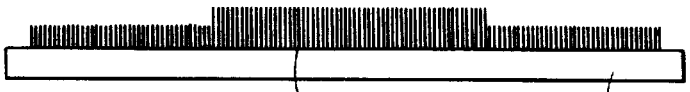
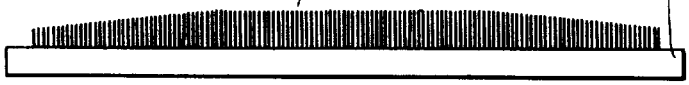
FIG. 19B
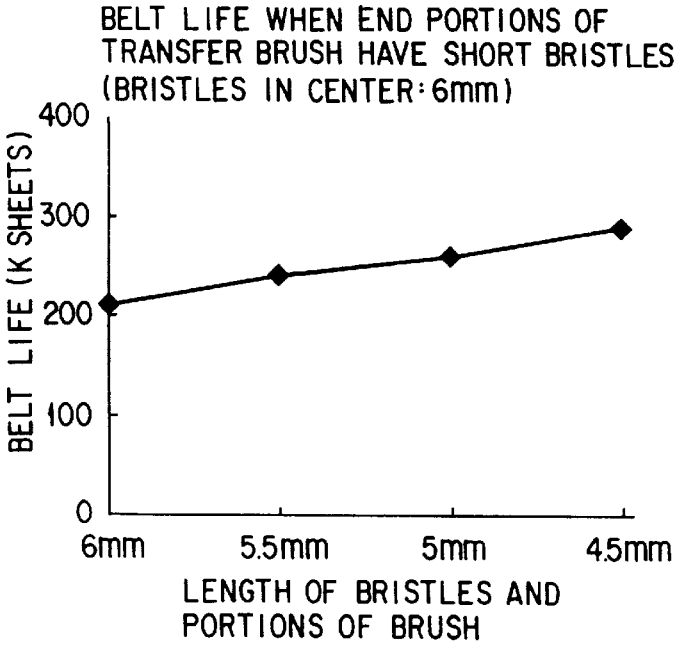
FIG. 20
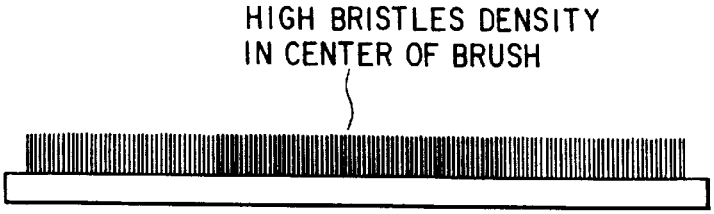
FIG. 21

IMAGE FORMING APPARATUS FOR ENABLING EASY SEPARATION OF RECORDING SHEETS FROM PHOTOSENSITIVE MEMBER

This application is a continuation of application Ser. No. 09/104,364, filed Jun. 25, 1998, U.S. Pat. No. 6,044,244.

BACKGROUND OF THE INVENTION

The present invention relates to an image forming apparatus for outputting an image by transferring a developer image from an image carrier to a transfer medium. More specifically, the invention relates to an image forming apparatus wherein the transfer medium is held on a transfer belt that is made to run while touching the surface of a photosensitive drum, and wherein a transfer bias is applied to the transfer belt from inside the region defined by the belt so as to transfer a toner image formed on the image carrier to the transfer medium held on the transfer belt.

In recent years, digital technology has made rapid progress in the technical field of image forming apparatuses of electrophotographic type, and many digital copying machines have come into wide use. A digital copying machine comprises: a scanner for converting light reflected by a document into digital signals and outputting the digital signals; an exposure section for exposing the surface of a photosensitive drum with laser beams corresponding to the digital signals, thereby forming an electrostatic latent image on the surface of the drum; a developing section for supplying toner, which serves as a developer, to the electrostatic latent image, thereby forming a toner image on the surface of the drum; a transfer belt which is made to run while touching the surface of the drum; and a transfer member for transferring the toner image from the surface of the drum to a recording sheet, which serves as a transfer medium and which is conveyed while being held on the transfer belt.

Many of the digital copying machines of this type employ a reversal development system. In a machine employing this system, the photosensitive drum and the transfer member become opposite in polarity in the transfer step. Since, therefore, the recording sheet assumes an opposite polarity to that of the photosensitive drum, it is electrostatically attracted by the photosensitive drum. Therefore, some measures have to be taken to separate the recording sheet from the photosensitive drum after the recording sheet has passed through the transfer region.

Many of the conventional laser printers are comparatively low in process speed, and the photosensitive drums they employ are comparatively small in diameter. Accordingly, recording sheets can be easily separated from the photosensitive drum by utilization of the resilience of the sheets. In order to facilitate the separation of recording sheets, separation means made of a corona charger or the like may be adopted, if so desired. By way of contrast, digital copying apparatuses are comparatively high in process speed and yet employ an organic photosensitive drum of comparatively low sensitivity. The diameter of that drum is inevitably large, and the separation based on the resilience of recording sheets is not easy. In consideration of these problems, some of the existing digital copying apparatuses employ a belt-like photosensitive member in place of the photosensitive drum, and that portion of the belt-like photosensitive member at which a recording sheet is separated therefrom has a comparatively large radius of curvature. Alternatively, some of the existing copying apparatuses employ a belt-like transfer member, and a recording sheet is electrostatically attracted by this belt-like transfer member.

However, these conventional techniques do not ensure easy separation of recording sheets from a photosensitive member while simultaneously maintaining the sufficiently reliable transfer characteristics that realize high-quality images.

BRIEF SUMMARY OF THE INVENTION

The present invention has been conceived in consideration of the above problems, and an object thereof is to provide an image forming apparatus which enables easy separation of recording sheets from a photosensitive member while maintaining reliable transfer characteristics, and which can therefore output images of high quality.

To attain this object, the present invention provides an image forming apparatus comprising: image formation means for forming an image on an image carrier; conveyance means for conveying a transfer medium, the conveyance means being kept in contact with the image carrier to define a contact region (A+B+C); and transfer means for transferring the image formed on the image carrier to the transfer medium conveyed by the conveyance means, the transfer means being arranged in the contact region (A+B+C) defined between the image carrier and the conveyance means, and being kept in contact with a reverse side of the conveyance means to define a contact region (A), a contact region (B) which is defined between the image carrier and the conveyance means and which is downstream of the contact region (A) between the conveyance means and the transfer means with respect to a running direction of the conveyance means, is smaller in area than a contact region (C) which is defined between the image carrier and the conveyance means and which is upstream of the contact region (A) with respect to the running direction of the conveyance means.

The present invention also provides an image forming apparatus comprising: image formation means for forming an image on an image carrier; a conveyance member arranged in contact with the image carrier to define a conveyance nip of a predetermined width, the conveyance member conveying a transfer medium in a predetermined direction; and a transfer member arranged in contact with the conveyance member and opposing the image carrier, with the conveyance member located therebetween, the transfer member serving to transfer the image formed on the image carrier to the transfer medium conveyed by the conveyance member, a transfer nip defined by contact between the transfer member and the conveyance member is within a distance of 1 mm or less of a downstream end of the conveyance nip where the conveyance member moves away from the image carrier, the distance of 1 mm being measured in the running direction of the conveyance member.

The present invention further provides an image forming apparatus comprising: image formation means for forming an image on an image carrier; a conveyance member arranged in contact with the image carrier to define a conveyance nip, the conveyance member conveying a transfer medium in a predetermined direction; and a transfer member arranged in contact with the conveyance member and opposing the image carrier, with the conveyance member located therebetween, the transfer member serving to transfer the image formed on the image carrier to the transfer medium conveyed by the conveyance member, the conveyance member separating from the transfer member at a downstream end of the conveyance nip, at which the conveyance member separates from the image carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 3 is a Table showing how the transfer characteristic of a halftone image and the separation characteristic of a recording sheet P are varied in accordance with a change in the proportion among the transfer nip A, prior-transfer conveyance nip C, and the posterior-transfer conveyance nip B shown in FIGS. 2A and 2B.

FIG. 10 is a Table showing the transfer characteristics of the case where a transfer roller is employed as the transfer member and the transfer characteristics of the case where a transfer brush is employed.

FIG. 12 is a Table showing how the transfer characteristics vary when the transfer nip and the prior-transfer conveyance nip, which is located upstream of the transfer region, are changed in a number of ways.

FIGS. 19A and 19B show examples of structures used to change the pressure applied to the transfer roller between the central and end portions of the roller.

FIG. 20 is a graph showing how the length of the bristles at the end portions of the transfer brush is related to the life of the transfer belt.

FIG. 21 shows a state where the density of the bristles is set higher at the central portion of the brush than at the end portions thereof.

DETAILED DESCRIPTION OF THE INVENTION

The first embodiment of the present invention will now be described in detail with reference to the accompanying drawings.

Figure 1:
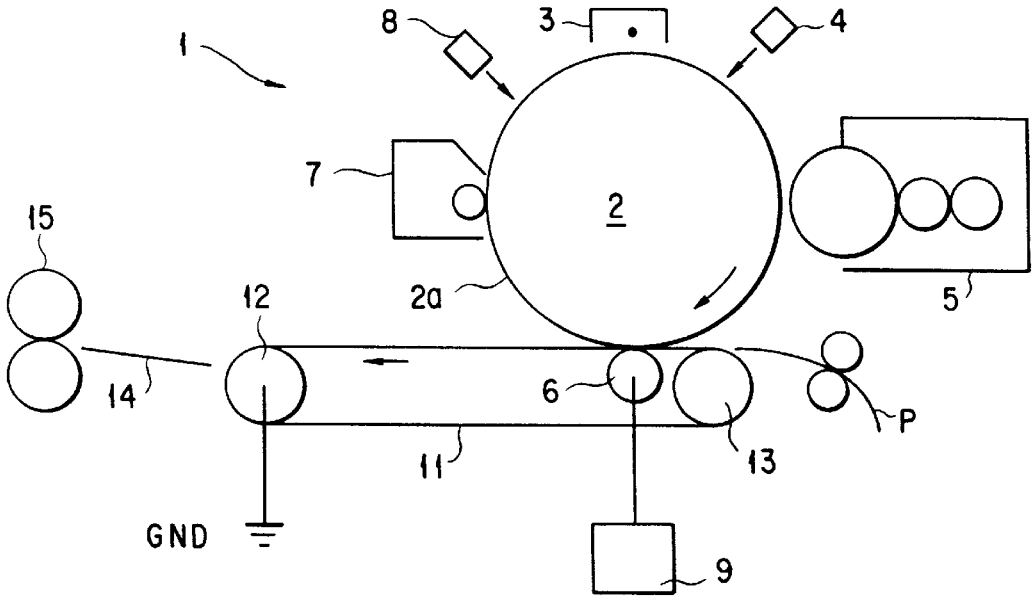
FIG. 1 is a schematic diagram showing the major portion of a digital copying machine according to the first embodiment of the present invention.

FIG. 1 is a schematic diagram showing the major portion of a digital copying machine 1 (hereinafter referred to simply as a copying machine 1), which is an image forming apparatus of the present invention. The copying machine 1 comprises a photosensitive drum 2 arranged substantially in the center thereof and serving as an image carrier.

Arranged around the photosensitive drum 2 are: a charger 3 for charging the surface 2*a* of the photosensitive drum 2 (hereinafter referred to simply as a drum surface 2*a*) at a predetermined potential level; an exposure unit 4 for exposing the charged drum surface 2*a* with light so as to form an electrostatic latent image; a developing unit 5 for supplying charged toner (which serves as a developer) to the electrostatic latent image, to thereby visualize the latent image; a transfer roller 6 (a transfer member) for transferring the toner image (developer image) to a recording sheet P that serves as an image-transferred medium; a cleaning unit 7 for cleaning the drum surface 2*a* to remove the toner which remains on the drum surface 2*a* without being transferred onto the recording sheet P; and a discharge lamp 8 for removing the charge from the drum surface 2*a*. These structural components are arranged in the rotating direction of the photosensitive drum 2 in the order mentioned.

A transfer belt 11 (a conveyance member) for holding and conveying the recording sheet P is arranged under the photosensitive drum 2. The transfer belt 11 is wound around both a driving roller 12 and a driven roller 13 that are spaced from each other, and is arranged such that it is kept in contact with the drum surface 2*a* to define a conveyance nip (to be mentioned later) having a predetermined width. In accordance with the rotation of the driving roller 12, the transfer belt is made to run in one direction. The transfer belt 11 runs in an endless manner at a speed corresponding to the circumferential speed of the photosensitive drum 2.

The transfer roller 6 is arranged inside the region formed by the transfer belt 11, and is urged such that it presses the transfer belt 11 against the surface 2*a* of the photosensitive drum 2. Since the transfer roller is formed of an elastic material, it contacts the inner side of the transfer belt 11 to define a transfer nip (to be described later) having a predetermined width. At the time, the transfer belt 11 is in contact with the drum surface 2*a* in the conveyance nip. A high-voltage power supply 9 for applying a transfer bias is connected to the transfer roller 6.

At a position which is downstream of the driving roller 12 with respect to the conveyance direction of the recording sheet P, a fixing unit 15 is arranged such that a guide member 14 is interposed between the fixing unit 15 and the driving roller 12. By this fixing unit 15, the recording sheet P bearing the toner image is clamped and conveyed. Simultaneous with this, the recording sheet P is heated, thereby permitting the toner image to melt and fixed onto the recording sheet P.

The copying machine having the above structure operates as follows.

First, the charger 3 uniformly charges the drum surface 2*a* such that the surface potential of the drum is within the range of −500V to −800V. Then, the exposure unit 4 forms an electrostatic latent image on the drum surface 2*a*. The developing unit 5 supplies toner (which is charged into the negative state) to the electrostatic latent image on the drum surface 2*a,* thereby visualizing the electrostatic latent image. Due to the rotation of the photosensitive drum 2, the toner image formed on the drum surface 2*a* is conveyed to the transfer region, where the transfer roller 6 is arranged in front of the photosensitive drum 2.

In synchronism with the toner image formed on the drum surface 2*a,* the recording sheet P conveyed by the transfer belt 11 is fed into the transfer region between the drum surface 2*a* and the transfer roller 6. At the time, the high-voltage power supply 9 applies the transfer roller 6 with a transfer bias which is in the range of 300V to 5 kV. As a result, the toner image conveyed to the transfer region is transferred from the drum surface 2*a* to the recording sheet P.

The transfer belt 11 is made of an elastic belt having a volume resistivity of $10^8$ to $10^{12}$ Ω·cm. The transfer roller 6 is made of a conductive elastic roller 6 having a volume resistivity of $10^2$ to $10^8$ Ω·cm. The transfer roller 6 applies a voltage to the photosensitive drum from the inner side of the transfer belt 11 by way of the transfer region.

When normal printing is performed, the transfer belt 11 and the photosensitive drum 2 are driven in the isolated state. After their speeds become substantially equal, they are brought into contact with each other, and the transfer roller 6 is applied with a transfer bias of a predetermined level. Simultaneous with this, the recording sheet P is conveyed through the transfer region. When passing through the transfer region, the recording sheet P is electrostatically attracted onto the transfer belt 11. The recording sheet P is separated from the transfer belt 11 at a downstream position of the transfer belt, since the driving roller 12 around which the transfer belt 11 is wound has a comparatively large radius of curvature (normally, ϕ12 mm to 40 mm). After separating from the transfer belt 11, the recording sheet P is guided by the guide member 14 and fed into the fixing unit 15. By this fixing unit 15, the toner image on the recording sheet P is melted and fixed onto the recording sheet P, thus forming an fixed image on the recording sheet.

After passing through the transfer region 2*a,* the drum surface 2*a* is cleaned by the cleaning unit 7 and electrically discharged by the discharge lamp 8, thus making preparations for the next image formation process.

Figure 2A:
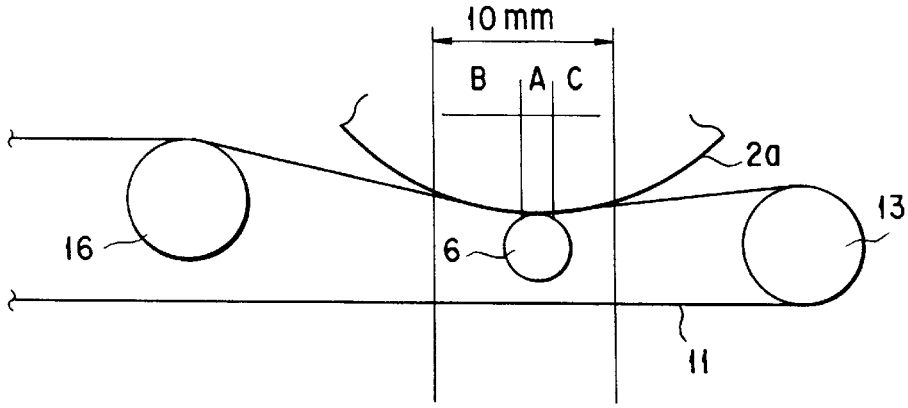
FIGS. 2A and 2B show specific examples of a conveyance nip and a transfer nip, the conveyance nip being defined between the surface of the photosensitive drum and the transfer belt of the copying machine shown in FIG. 1, and the transfer nip being defined between the surface of the drum and the transfer roller.
Figure 2B:
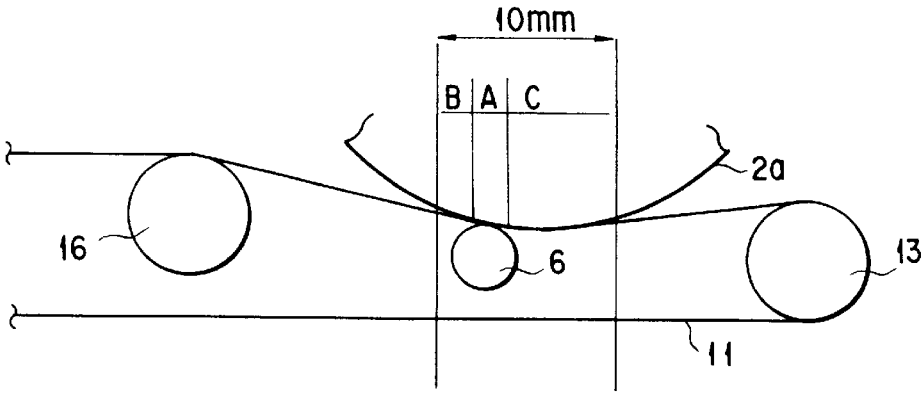

FIGS. 2A and 2B schematically illustrate the positional relationships between a conveyance nip (A+B+C) and a transfer nip (A), the conveyance nip (A+B+C) being defined by the contact between the transfer belt 11 and the drum surface 2*a,* and the transfer nip (A) being defined by the contact between the transfer roller 6 and the inner side of the transfer belt 11. In the examples shown in FIGS. 2A and 2B, the width of the conveyance nip is determined to be 10 mm.

In the example shown in FIG. 2A, the transfer roller 6 is located substantially at the center of the conveyance nip (A+B+C), and the transfer nip (A) is formed substantially at the center of the conveyance nip (A+B+C). The prior-transfer conveyance nip C (which is upstream of the transfer nip A with respect to the feeding direction of the recording sheet P) and the posterior-transfer conveyance nip B (which is downstream of the transfer nip A with respect to the feeding direction of the recording sheet P) are substantially equal in width. An auxiliary roller 16 is arranged inside the circle defined by the transfer belt 11 such that it is located in a region downstream of the transfer roller 6. The auxiliary roller 16 raises the transfer belt 11 so as to permit the width of the conveyance nip to be a predetermined value (e.g., 10 mm).

FIG. 2B shows the case where the proportion between the width of the prior-transfer conveyance nip C and the width of the posterior-transfer conveyance nip B is varied by shifting the position of the transfer roller 6. The transfer characteristics of a halftone image and the separation characteristics of the recording sheet P from the drum surface 2*a* are examined in relation to a change in the proportion, and results of the examination are shown in FIG. 3. The data in FIG. 3 shows how the transfer characteristics and the separation characteristics are when the transfer nip A, which is defined by the contact between the transfer roller 6 and the transfer belt 11, has widths of 2 mm and 4 mm.

From the data in FIG. 3, it can be seen that pock-like marks or stains arising from undesirable electrical discharge during the formation of a halftone image are easily produced when the width of the prior-transfer conveyance nip C is less than that of the posterior-transfer conveyance nip B, and that the production of the pock-like marks has no relation to the width of the transfer nip A. It can be also seen that where the width of the prior-transfer conveyance nip C is less than the width of the posterior-transfer conveyance nip B, the separation characteristics of the recording sheet P from the drum surface 2*a* are degraded, particularly in a high-temperature and high-humidity environment.

In order to improve the separation characteristics of the recording sheet P while simultaneously maintaining the satisfactory transfer characteristics of a halftone image, it is necessary to determine the width of the posterior-transfer conveyance nip B to be less than that of the prior-transfer conveyance nip C, and the width of transfer nip A itself need not be considered. In other words, the transfer roller 6 should be positioned in such a manner as to satisfy the relationship C>B. As long as the transfer roller 6 is positioned in this manner, the satisfactory transfer characteristics of halftone images are maintained, and yet the separation characteristics of the recording sheet P can be improved. If the posterior-transfer conveyance nip B can be reduced to zero, this would be most desirable.

A description will now be given of the second embodiment, which is another aspect of the present invention. Since the second embodiment is similar to the first embodiment in structure, the same reference numerals as used in describing the first embodiment will be used to refer to the corresponding or similar structural elements, and a detailed description of such structural elements will be omitted.

Figure 4A:
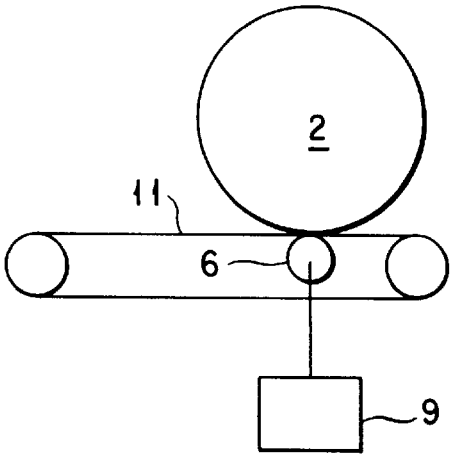
FIGS. 4A to 4C illustrate positions at which the transfer roller of the copying machine in FIG. 1 is arranged.

In general, the transfer roller 6 is arranged just under the photosensitive drum 2, as shown in the example in FIG. 4A. However, the transfer roller 6 may be arranged as in the second and third examples depicted in FIGS. 4B and 4C. In the second example depicted in FIG. 4B, the transfer roller 6 is shifted from the position directly underneath the photosensitive drum 2 such that the transfer roller 6 is located downstream of the drum 2 with respect to the running direction of the transfer belt 11. In the third example depicted in FIG. 4C, the transfer roller 6 is located slightly downstream of the position which directly underneath the photosensitive drum 2, in such a manner that the transfer roller 6 is continuous to the transfer nip defined by the contact between the photosensitive drum 2 and the transfer belt 11.

In the case where the transfer roller 6 is located away from the photosensitive drum 2 as in the second example, the transfer roller 6 is not pressed against the photosensitive drum 2. In this case, the transfer roller 6 need not be elastic; it may be a metallic roller, for example. The structure can be simplified, accordingly.

Figure 4B:
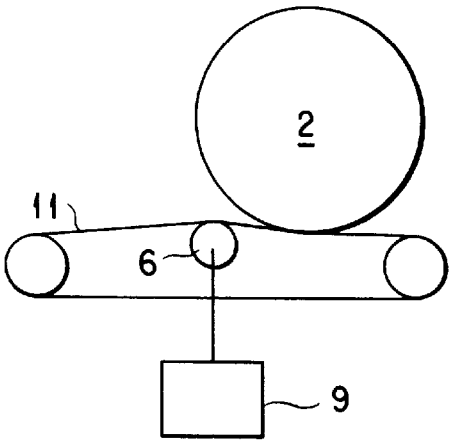
Figure 4C:
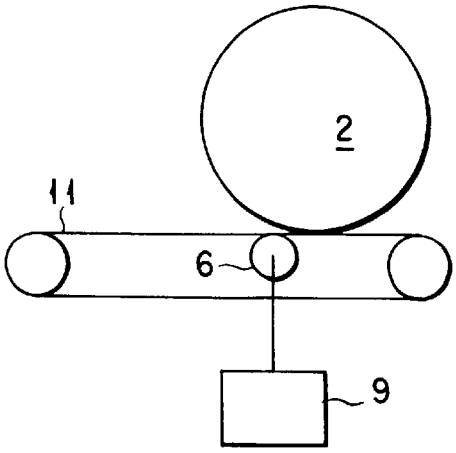
Figure 5A:
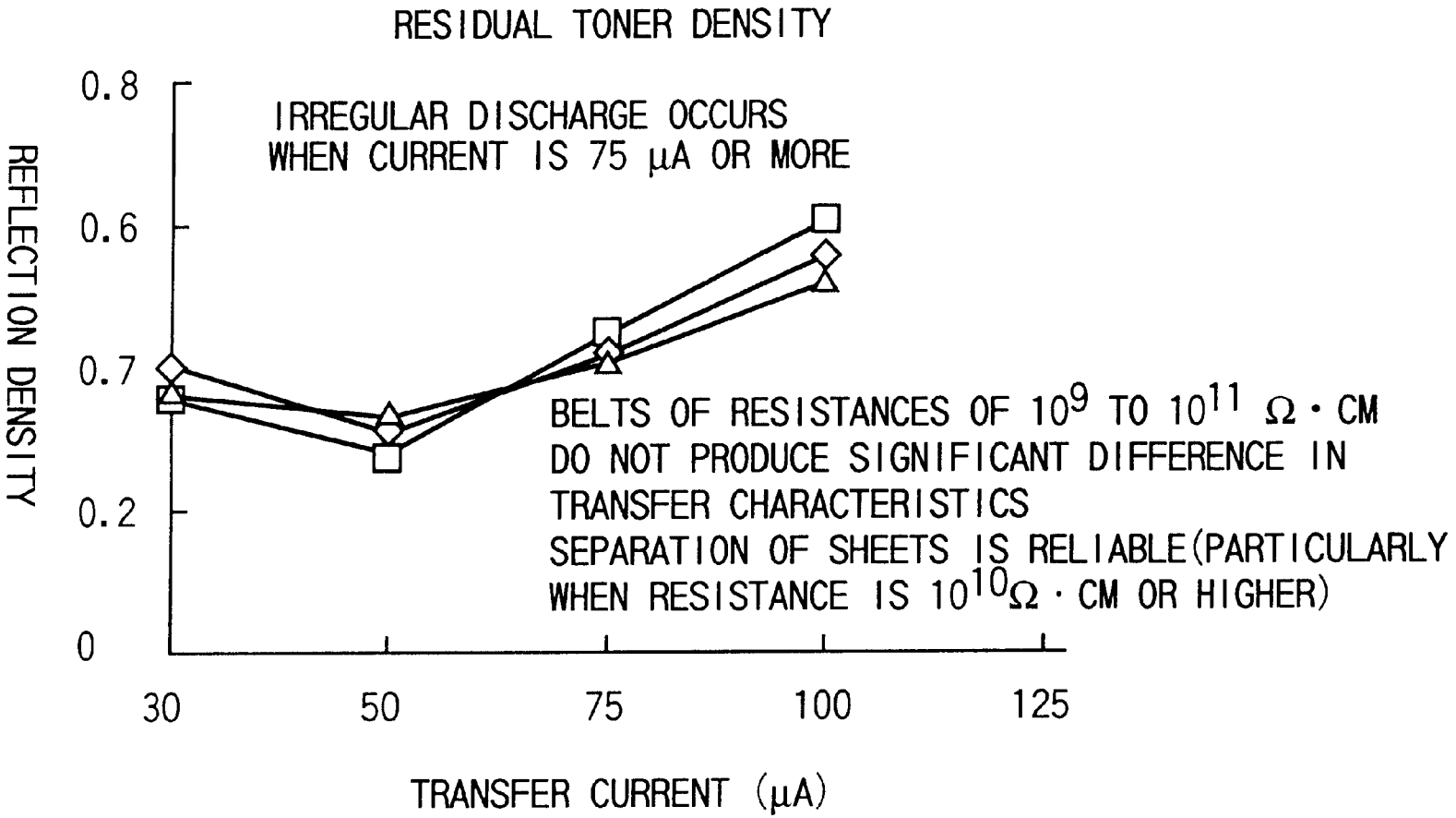
FIGS. 5A to 5C are graphs corresponding to the illustrations in FIGS. 4A to 4C, respectively, and illustrating the transfer efficiency in relation to the transfer current.
Figure 5B:
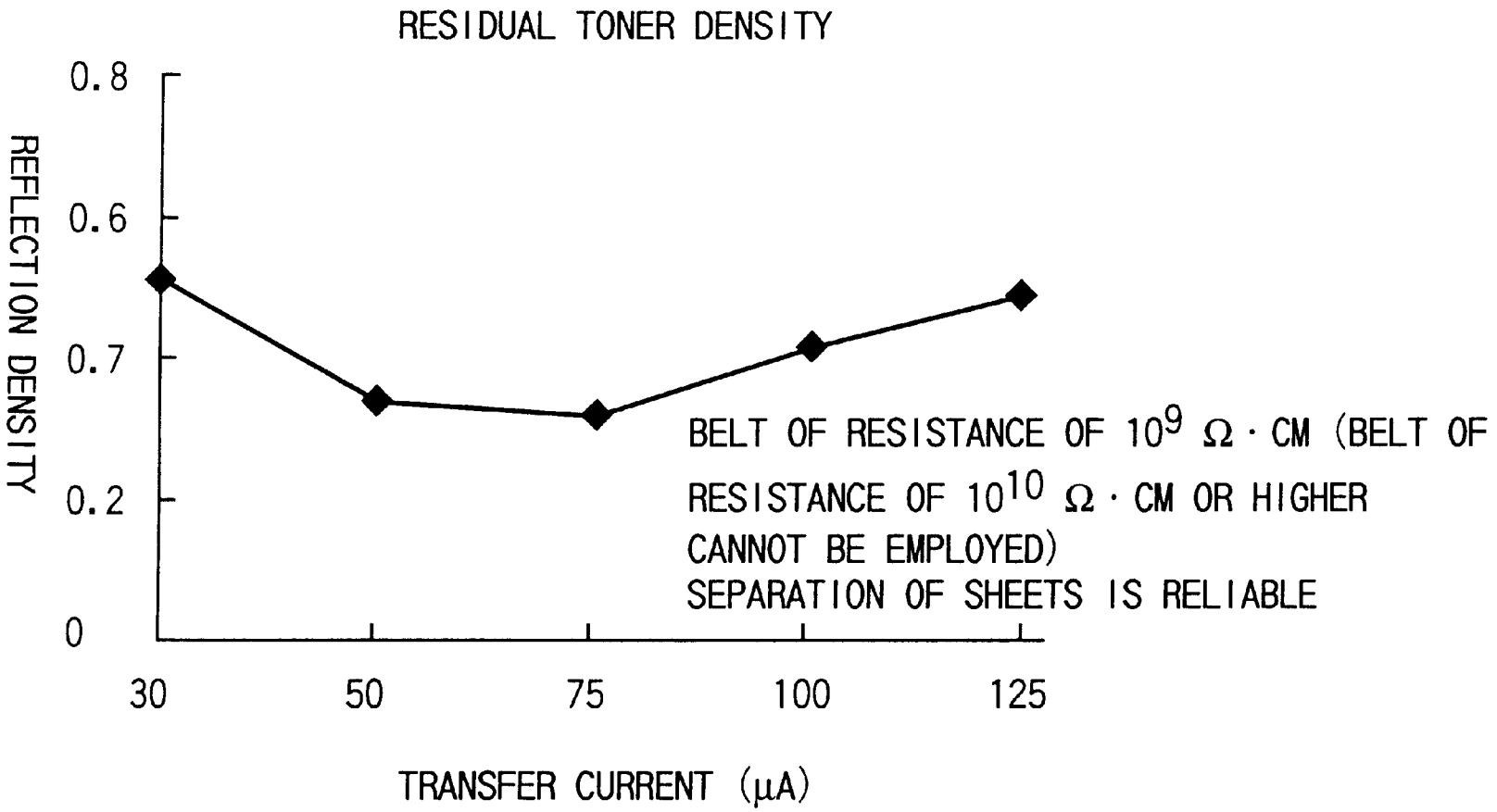
Figure 5C:
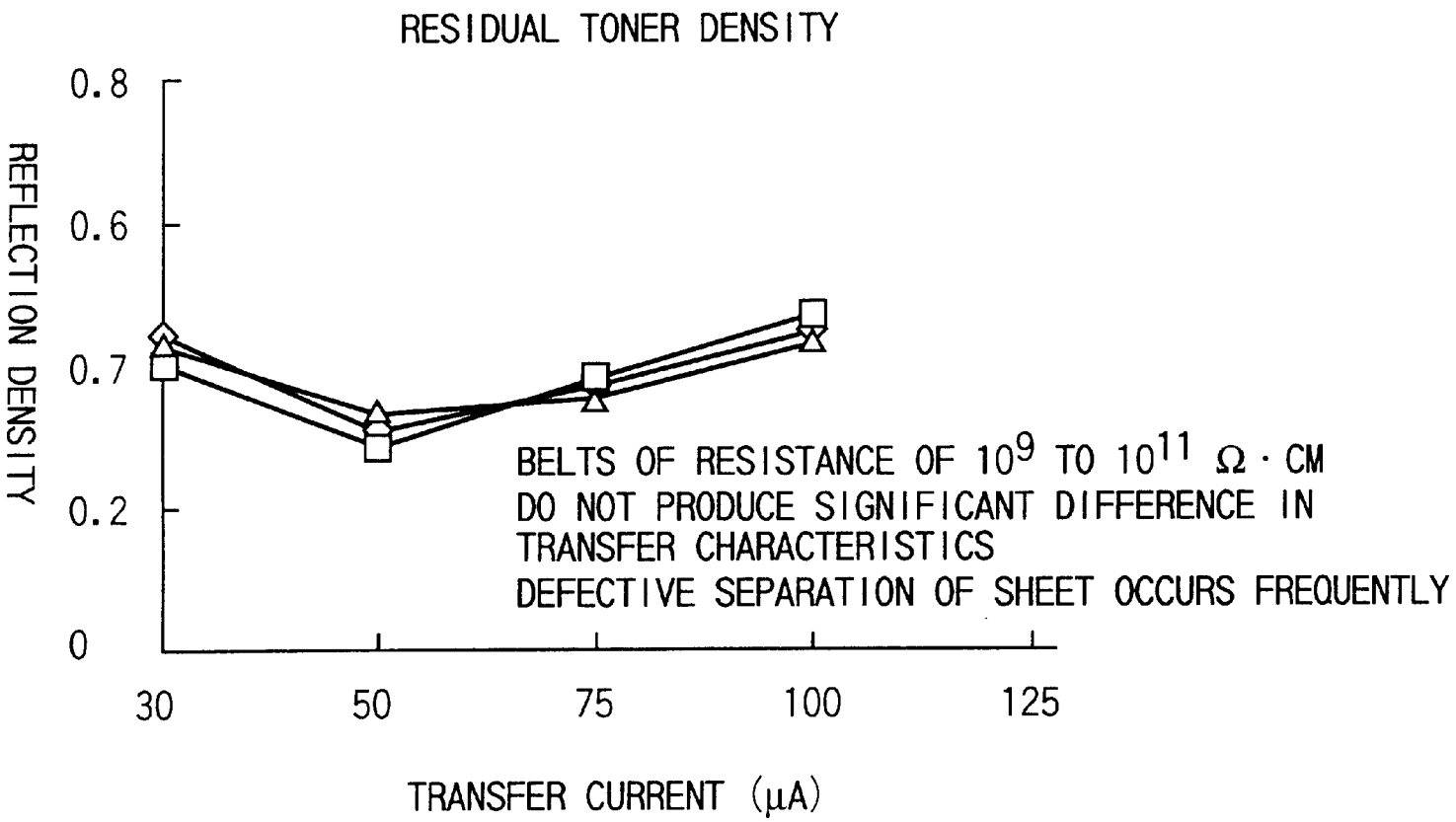

In the examples shown in FIGS. 4A to 4C, the transfer margins and the separation characteristics of the recording sheet P were measured while changing the transfer current supplied to the transfer roller 6 and the belt resistance of the transfer belt 11. The results of the measurement are shown in FIGS. 5A to 5C. The copying machine used for obtaining the data shown in FIGS. 5A to 5C is a reversal development system whose process speed is 400 mm/sec, and the surface potential of the drum surface 2*a* is set at −600V, and the developing bias is set at −400V. When obtaining the data shown in the graphs in FIGS. 5A to 5C, the transfer current was varied under the constant current control, and the reflection density of the residual toner remaining on the drum surface 2*a* was measured immediately after a test chart was transferred from the drum surface 2*a* to the recording sheet P. If the reflection density is low, this means that the transfer efficiency is high.

In the first example shown in FIGS. 4A and 5A, the recording sheet P was reliably attracted onto the transfer belt 11, and the transfer characteristics remained substantially unchanged when the belt resistance was varied within the range of $10^9$ to $10^{11}$ Ω·cm. (In the graph, data obtained when the belt resistance's were $10^9$ Ω·cm, $10^{10}$ Ω·cm and $10^{11}$ Ω·cm are depicted.) However, when the value of transfer current was increased, stains arising from electrical discharge were easily produced in an image, and this phenomenon was particularly marked when that image was a halftone one.

In the second example shown in FIGS. 4B and 5B, the margin of the transfer current was wide, and the recording sheet P was reliably attracted onto the transfer belt 11. However, reliable transfer was not possible when the transfer belt 11 used had a resistance of $10^{10}$ Ω·cm or higher.

In the third example shown in FIGS. 4C and 5C, the transfer characteristics were hardly affected over the belt resistance range of $10^9$ Ω·cm to $10^{11}$ Ω·cm. The margin of the transfer current was wide, as in the second example, but the recording sheet P is apt to attach to the drum surface 2*a*. The separation characteristics of the recording sheet P were not therefore satisfactory.

In the first example, stains due to electric discharge remain on the sheet. This is attributed to the following reason. If the potential at the photosensitive drum 2 is high in the region close to the entrance of the conveyance nip, which is defined by the contact between the transfer belt 11 and the drum surface 2*a,* a large potential difference is brought about between the transfer belt 11 and the photosensitive drum 2, resulting in electric discharge. This phenomenon hardly takes place in the second and third examples, since in these examples the potential at the surface of the transfer belt 1 is comparatively low in the region close to the entrance of the conveyance nip.

In the second example, the transfer roller 6 is completely isolated from the photosensitive drum 2, and the margin of the resistance of the transfer belt 11 is narrow. In other words, where the transfer belt 11 has a high resistance, the transfer bias is not applied to the conveyance nip between the drum surface 22*a* and the transfer belt 11. On the other hand, if the transfer belt 11 has a low resistance, the potential at the transfer belt 11 is low in the region close to the entrance of the conveyance nip, which is a matter of consequence in the case of the structure depicted in FIG. 4B. In addition, since the roller located upstream of the transfer region is grounded or its potential is set at a lower level than that of the transfer region, it is likely that a current will easily flow through the transfer belt 11. As can be seen from this, where the transfer belt 11 used has a low resistance, the value of the current required for transferring a toner image greatly varies, depending upon the resistance of the transfer belt 11.

In the third example, the recording sheet P is easily attracted onto the drum surface 2*a*. This attributable to the structure wherein that part of the transfer belt 11 which is located downstream of the transfer roller 6 extends along the transfer roller 6 and in a direction away from the drum surface 2*a*. To be more specific, the leading end of the recording sheet P is guided in the tangential direction of the drum surface 2*a* when it has passed through the conveyance nip. In spite of this, however, the transfer belt 11 extends in a direction away from the drum surface 2*a* from the terminating end of the conveyance nip. With this structure, it is likely that the leading end of the recording sheet P will attach to the drum surface 2*a* when it has passed through the conveyance nip. If, as in the first and second examples, the transfer belt 11 extends in the tangential direction of the photosensitive drum 2 from the terminating end of the conveyance nip, and the recording sheet P is made to move along the transfer belt 11, the recording sheet P does not easily attach to the drum surface 2*a*.

Figure 6:
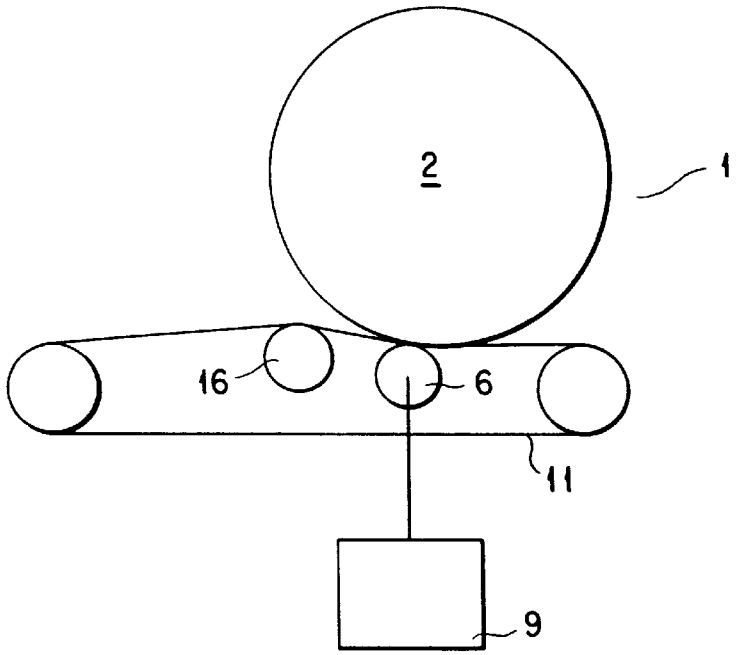
FIG. 6 is a schematic view showing the major portion of a copying machine according to the second embodiment of the present invention.

In consideration of the above, the embodiment of the present invention adopts the structure shown in FIG. 6. As shown in FIG. 6, the auxiliary roller 16 is arranged in the region inside the transfer belt 11, in addition to the transfer roller 6. As in the third example described above with reference to FIG. 4C, the conveyance nip defined only by the contact between the drum surface 2*a* and the transfer belt 11 is provided. The transfer roller 6 is located downstream of that conveyance nip, with the transfer nip provided therebetween. The auxiliary roller 16 is located downstream of the transfer nip so that the transfer belt 11 moves away from the drum surface 2*a* in the tangential direction of the photosensitive drum 2. In short, the auxiliary roller 16 serves to urge the transfer belt 11 slightly upward.

Figure 7:
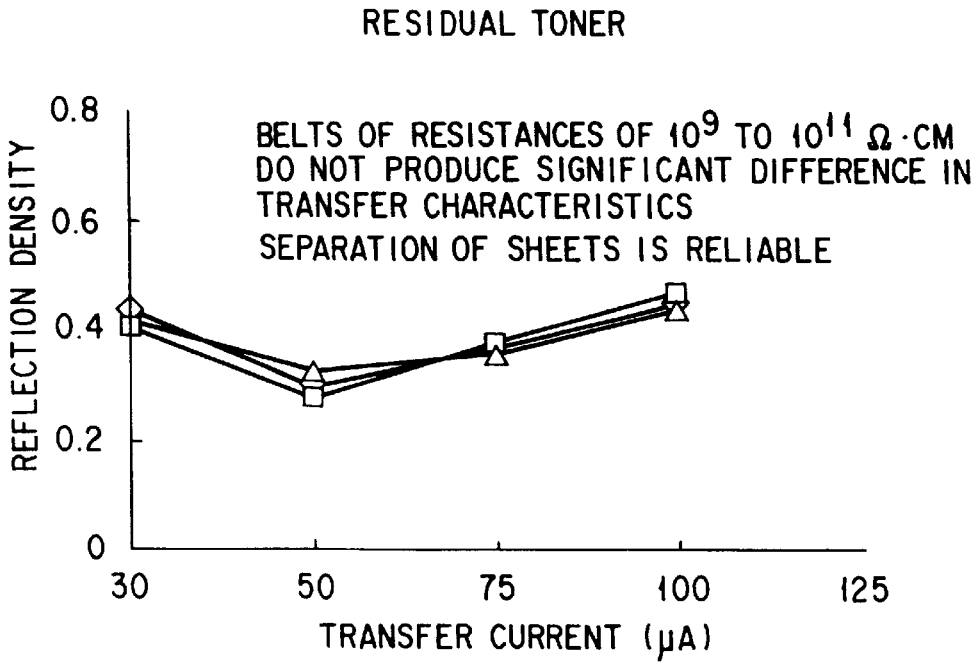
FIG. 7 is a graph illustrating how the transfer efficiency is related to the transfer current in the copying machine shown in FIG. 6.

With respect to this structure, the margin of the transfer current and the margin of the belt resistance were examined, as in the first to third examples described above. The results of the measurement are shown in FIG. 7. As can be seen from FIG. 7, the density of the residual toner was similar to that of the third embodiment when the belt resistance of the transfer belt was in the range of $10^9$ to $10^{12}$ Ω·cm, and the separation characteristics of the recording sheet P was as satisfactory as that of the second example. The hardness of the transfer roller 6 was set to be 20° and 60°.

As described above, the transfer belt 11 is made to extend in the tangential direction of the photosensitive drum 2 in the region downstream of the transfer region, and the auxiliary roller 16 is arranged in such a manner that the recording sheet P moves along the transfer belt 11 after passing through the transfer region. With this structure, satisfactory transfer characteristics cab be maintained, and yet the separation characteristics of the recording sheet with reference to the drum surface 2*a* can be improved.

Figure 8:
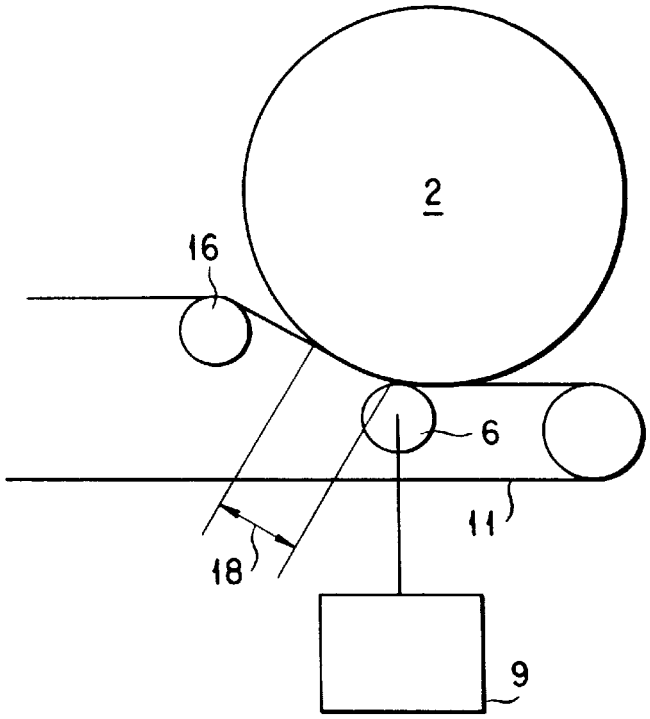
FIG. 8 shows the state where the auxiliary roller of the copying machine in FIG. 6 has been moved to the upper position.

If the auxiliary roller 16 is raised to the position shown in FIG. 8, and that portion of the transfer belt 11 which has passed through the transfer region is thereby pressed against the drum surface 2*a,* part of the image may not be transferred, or the transferred image may be blurred. In other words, satisfactory transfer without missing image portions or image blurring, reliable separation characteristics of the recording sheet P and wide margins cannot be attained simultaneously, if the transfer belt 11 is kept in contact with the drum surface 2*a* more than necessary after it passes through the transfer region and separates from the transfer roller 6.

Figure 9:
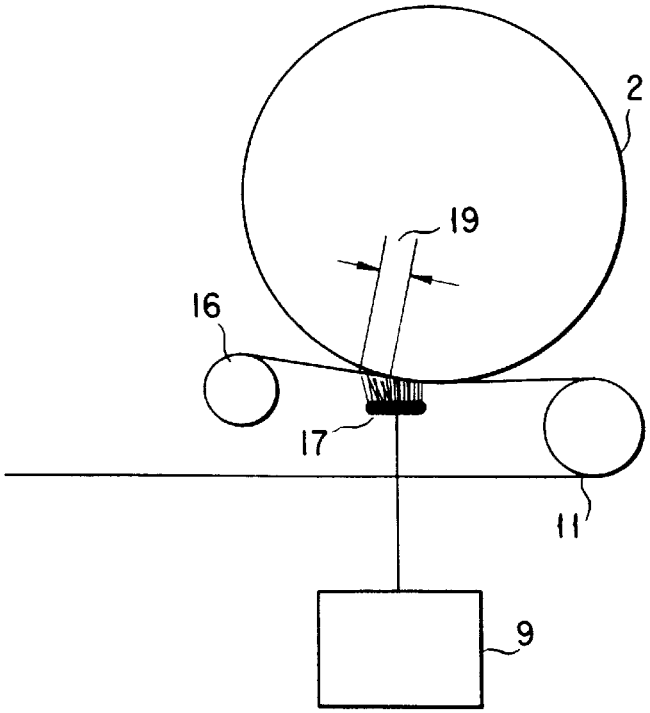
FIG. 9 shows the state where a transfer brush is employed in place of the transfer roller in the copying machine shown in FIG. 6.

With respect to the cases where the transfer roller 6 shown in FIG. 8 and the case where the fixed-type transfer brush 17 shown in FIG. 9 were employed as a transfer member, missing image portions, image blurring and the occurrence of irregular discharge were examined while changing the state of the transfer belt 11 in the neighborhood of the transfer member. The results of the examination are shown in FIG. 10. In the case shown in FIG. 8, the nip width 18 defined by the contact between the transfer belt 11 and the drum surface 2*a* in the region downstream of the transfer roller 6 is varied. In the case shown in FIG. 9, the width 19 of the transfer belt portion which has separated from the drum surface 2*a* and with which the only the transfer brush 17 is in contact is varied. In the Table shown in FIG. 10, width 18 is indicated as being positive, while width 19 is indicated as being negative.

The data in FIG. 10 shows the following: In the case where the transfer roller 6 was employed, image blurring became conspicuous if the transfer belt 11 was kept in contact with the transfer roller 6 for a length of 1 mm or more after it separated from the transfer roller 6. In the case where the transfer brush 17 was employed, irregular discharge occurred if the transfer brush 17 was made to touch the transfer belt 11 for a length of 1 mm or more after it separated from the drum surface 2*a*. It follows from these results that the transfer member should be arranged at a position within 1 mm of the position at which the transfer belt 11 separates from the photosensitive drum 2. As long as the transfer member is arranged in this manner, missing image portions, image blurring and occurrence of electric discharge can be suppressed.

Figures 11, 23:
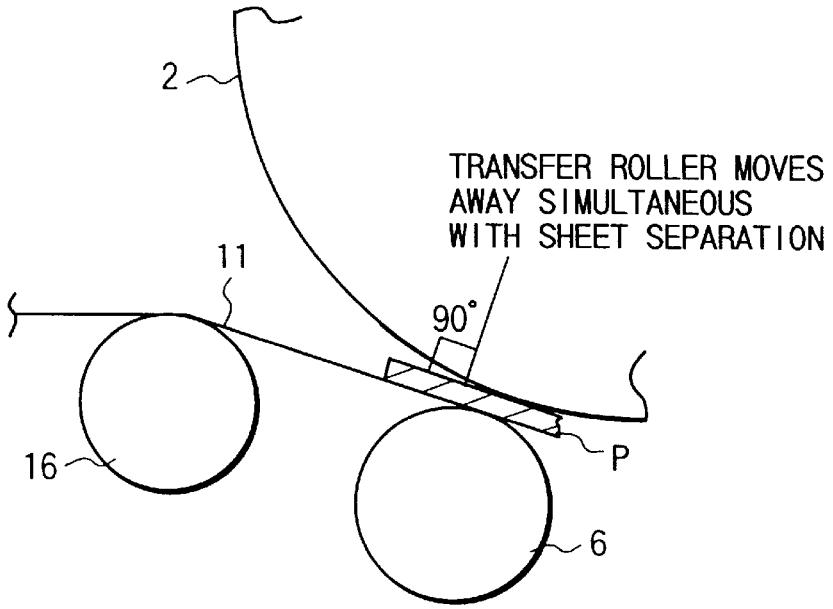
FIG. 11 is a schematic view showing the state where the transfer roller is arranged at a position where the transfer belt moves away from the surface of the drum in the copying machine shown in FIG. 6.
FIG. 23 indicates how the transfer belt is when the belt unit is moved.

When the transfer member (the transfer roller 6 or transfer brush 17) was so arranged in such a manner that it separates from the reverse side of the transfer belt 11 at the sane position where the recording sheet P separates from the photosensitive drum 2 (this arrangement is indicated as being "0 mm" in the Table shown in FIG. 10), a very reliable image could be output. In an actual copying machine, the transfer member cannot be arranged in the manner shown in FIG. 11, due to the difference in the thicknesses of the recording sheets P to be used. The arrangement shown in FIG. 11 is ideal.

The width of the prior-transfer conveyance nip which is defined by the contact between the drum surface 2*a* and the transfer belt 11 in the region upstream of the transfer region (i.e., the region where the transfer roller 6 is arranged in opposition to the drum surface 2*a*), and the width of the transfer nip which is defined by pressing the transfer roller 6 against the drum surface 2*a,* with the transfer belt 11 interposed, were varied in various manners, and how these widths were related to defective transfer or irregular discharge was examined. The results of this examination are shown in FIG. 12. The data shown in FIG. 12 indicates that the width of the prior-transfer conveyance nip located upstream of the transfer region should be 1 mm or more and that the width of the transfer nip defined between the transfer roller 6 and the transfer belt 11 should be 2 mm or more. As long as the widths of these two nips are determined in this manner, electric discharge does not occur when a halftone image is formed, and an image of good quality can be obtained.

As described above, in the copying machine of the present invention, (i) the auxiliary roller 16 is employed to permit the transfer belt 11 to separate from the photosensitive drum 2 in the tangential direction of the drum 2, (ii) the transfer member is arranged within 1 mm of the position at which the transfer belt 11 separates from the photosensitive drum 11, (iii) the width of the prior-transfer conveyance nip, which is defined by the contact between the photosensitive drum 2 and the transfer belt 11 upstream of the transfer region, is set to be 1 mm or more, and (iv) the width of the transfer nip defined by pressing the transfer member against the drum surface 2*a,* with the transfer belt interposed, is set to be 2 mm or more. With this structure, satisfactory transfer characteristics are maintained, and yet the separation characteristics of the recording sheet P from the photosensitive drum 2 can be improved. Accordingly, images of good quality can be output.

Figure 13:
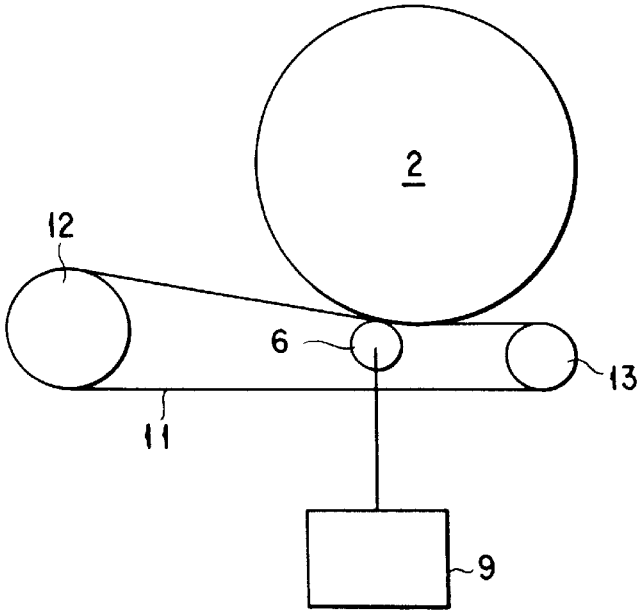
FIG. 13 is a schematic illustration of the case where the auxiliary roller of the copying machine shown in FIG. 6 is replaced with a large-diameter driving roller.

As an alternative to the auxiliary roller 16 employed in each of the foregoing embodiments, the structure shown in FIG. 13 is conceivable. As shown in FIG. 13, a driving roller 12 having a slightly large diameter is employed in place of the auxiliary roller 16. Such a driving roller 12 permits the recording sheet P to separate from the photosensitive drum 2 in the tangential direction of the drum 2.

A description will now be given of the third embodiment of the present invention.

The third embodiment is directed to a technique for extending the life of the transfer belt 11.

A running test was conducted by use of the copying machine 1 of the above structure. In the test, a transfer roller having a hardness of 45° (Asker-c) was employed as a transfer member, the transfer bias is controlled with a constant current of 50 μA, and a 5%-chart was printed on A4-sized paper. The running test was conducted by feeding 400,000 recording sheets P. When about 200,000 recording sheets P were fed, the surface layer of the transfer belt 11 peels off at positions corresponding to the edges of the recording sheets P.

A large amount of paper dust is generated when the recording sheet P passes through the conveyance nip between the drum surface 2*a* and the recording sheet P. Such paper dust attaches on the transfer belt 11, particularly on the belt portions corresponding in position to the end portions of the recording sheets P. The paper dust undesirably abrades the surface of the belt when it is located in the conveyance nip or at a position facing the cleaning unit 7. Therefore, when recording sheets P of the same size are kept fed, the surface layer of the transfer belt 11 may be abraded at positions corresponding to the end portions of the recording sheets P. If this abrasion continues to take place, the rubber layer of the belt 11 may be exposed, and the surface portion may come off the blade of the cleaning unit 7.

The life of the transfer belt 11 is determined by a variety of factors, including the amount of paper dust generated from recording sheets P, the compatibility between the cleaning blade and the transfer blade, the width and pressure of the conveyance nip which is defined between the photosensitive drum 2 and the transfer belt 11 and which is conveys the recording sheet P in the clamped state, the pressure applied to the transfer member, and the width of the transfer nip. Therefore, to reduce the pressure which the transfer belt 11 applied to the drum surface 2*a* may be one of the methods for extending the life of the transfer belt 11. The pressure exerted at the conveyance nip is determined by two kinds of pressure: the pressure which the transfer belt applies to the drum surface 2*a,* and the pressure which the transfer member applies to the transfer belt 11. If the former pressure is changed, however, the running condition of the transfer belt 11 is adversely affected, so that it is not possible to greatly change the former pressure.

In consideration of the above, according to the third embodiment, the pressure with which the transfer member is pressed against the transfer belt 11 is changed, so as to extend the life of the transfer belt 11.

Figure 14:
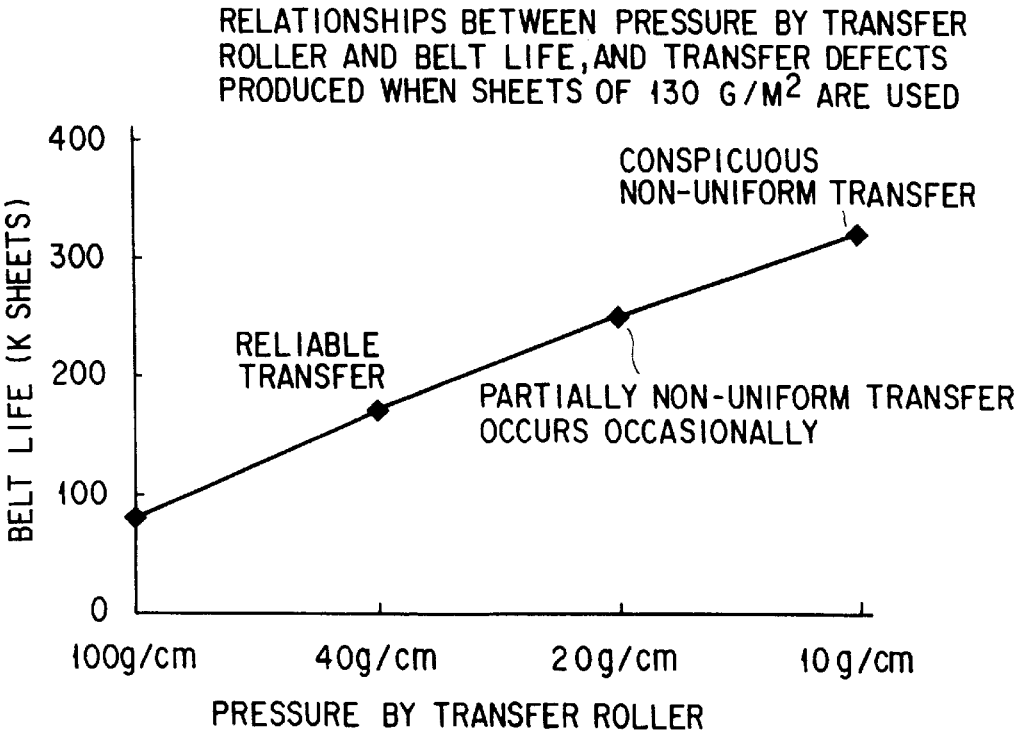
FIG. 14 is a graph showing how the pressure applied to the transfer roller and the life of the transfer belt are related to each other.

A running test was carried out under predetermined conditions, so as to examine how the pressure that the transfer roller applies to the transfer belt 11 is related to the life of the transfer belt 11. In the running test the pressure that the transfer roller applies to the transfer belt 11 is changed. The results of the running test are shown in FIG. 14. As can be seen from FIG. 14, reliable transfer characteristics were achieved when the pressure applied from the transfer roller 6 to the transfer belt 11 was determined to be 40 g/cm (the length being measured in the longitudinal direction of the transfer roller).

The data in FIG. 14 shows that the lower the pressure applied by the transfer roller 6 is, the longer will be the life of the transfer belt 11. However, if the pressure is too low, reliable transfer and stable conveyance may not be expected. For example, if the recording sheet P is so thick as to exceed 130 g/m$^2$, transfer defects may be produced in the direction perpendicular to the conveyance direction of the recording sheet P, or the recording sheet P itself may not be conveyed smoothly. In other words, if the recording sheet P is stiff, it may partly move out of the transfer nip due to its resiliency, resulting in transfer defects or unstable conveyance. To prevent this situation, the recording sheet P must be clamped with pressure strong enough to overcome the resiliency of the sheet P.

Figure 15A:
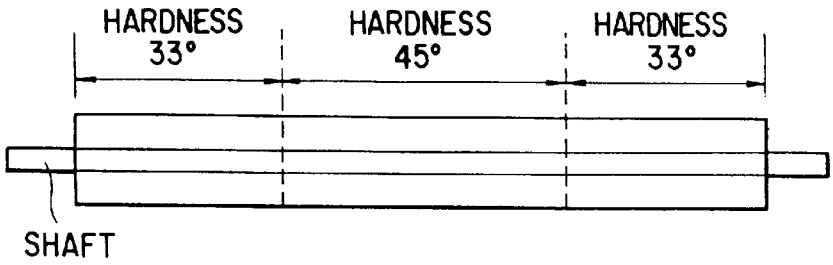
FIGS. 15A and 15B show examples of structures used to change the pressure applied to the transfer roller between the central and end portions of the roller.
Figure 15B:
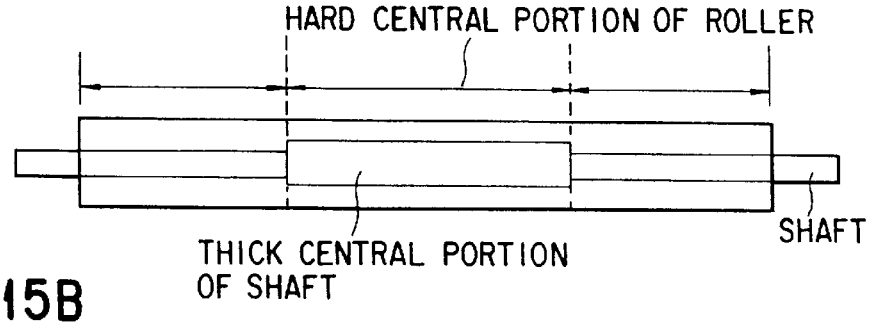

With the above in mind, the transfer rollers shown in FIGS. 15A and 15B have been conceived. In the transfer roller shown in FIG. 15A, the central portion has a normal hardness, while the end portions, used mainly for guiding the end portions of recording sheets P, have a hardness smaller than that of the central portion. With this structure, since a thick recording sheet P is held by the central portion of the transfer roller 6, transfer defects are not produced. In addition, since the pressure applied to the end portions of the recording sheet is low, the running life of the transfer belt is extended.

In the transfer roller shown in FIG. 15B, the shaft of the transfer roller 6 has a larger diameter in the central portion than in the end portions. This structure produces similar effects to those of the structure shown in FIG. 15A, because the apparent hardness of the roller becomes high in the central portion of the roller.

Figure 16:
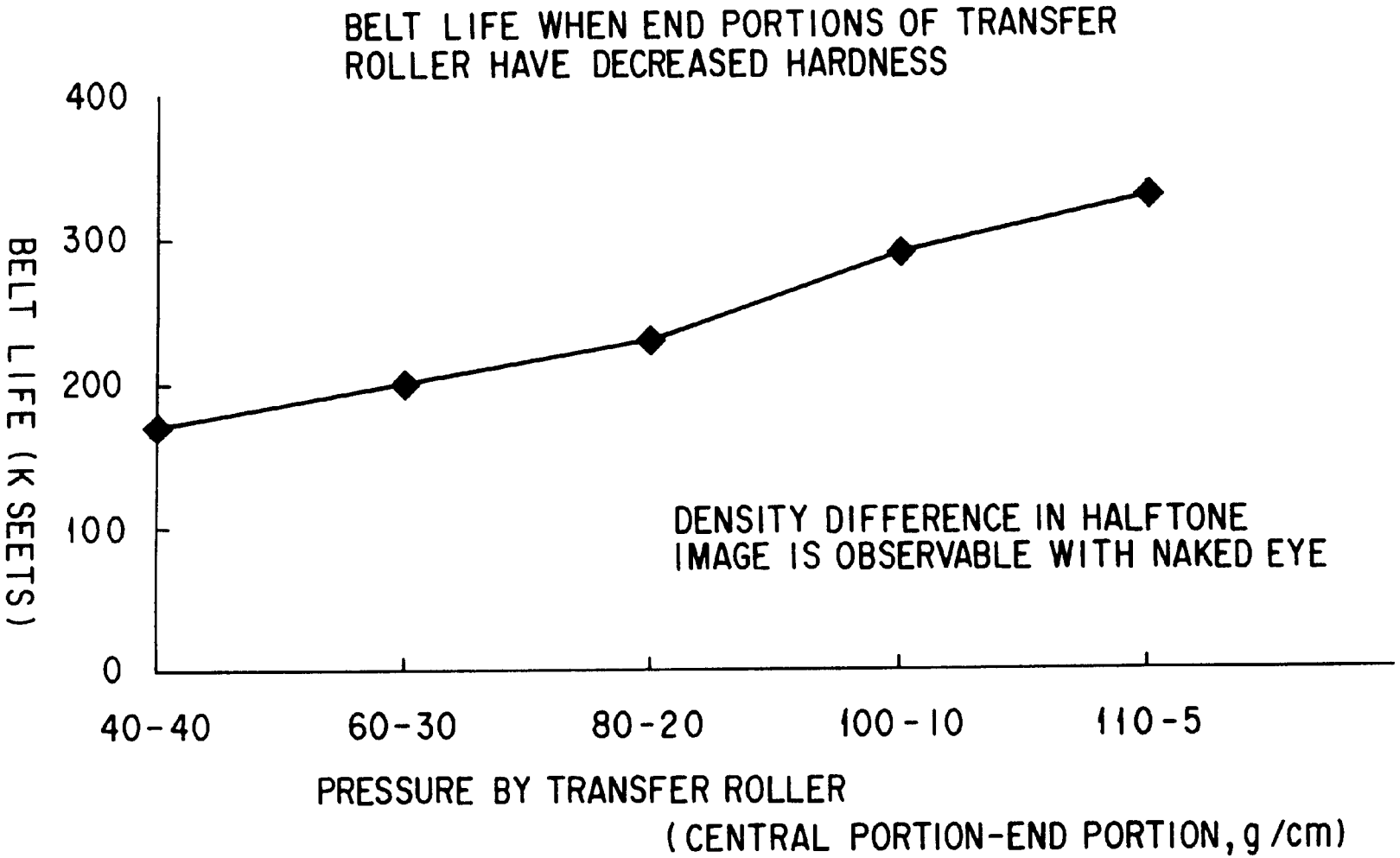
FIG. 16 is a graph showing how the pressures applied to the central and end portions of the transfer roller are related to the life of the transfer belt.

As indicated in the graph shown in FIG. 16, where the hard central portion of the transfer roller 6 was about 100 mm, the pressure applied to the central portion of the recording sheet P was in the range of 40 to 100 g/cm, while the pressure applied to the end portions was in the range of 10 to 40 g/cm. In this case, the images produced were of good quality, and no clear density difference was observed in them. In addition, the running life of the transfer belt 11 could be extended.

Figure 17:
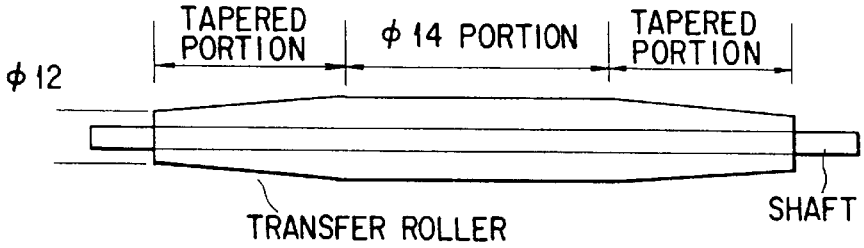
FIG. 17 shows a transfer roller having tapered end portions.

Similar effects could also be produced by the transfer roller 6 shown in FIG. 17. The diameter of this transfer roller is varied along the axial direction of the transfer roller 6. Although the transfer roller 6 has the same hardness throughout its length, the diameter of the roller is smaller approximately by Φ1 to Φ4 in the portions through which the end portions of recording sheets P pass. In the experiment conducted by Applicants, the central portion of the transfer roller (i.e., a 10 cm portion in the center of the roller) had a normal diameter, and the end portions of the roller were tapered such that the diameter of the roller gradually decreased.

Figure 18:
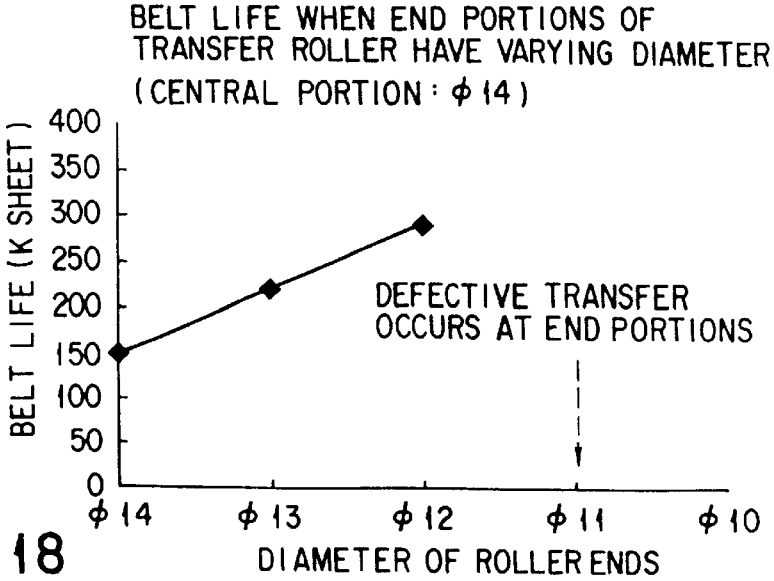
FIG. 18 is a graph showing how the diameters of the end portions of the transfer roller are related to the life of the transfer belt.

The graph in FIG. 18 shows how the life of the transfer belt was when the diameter of the roller was varied at the end portions, with the diameter thereof kept constant in the central portion. From the graph in FIG. 18, it can be seen that transfer defects are easily produced where the end portions of the transfer roller are very small in diameter. At the same time, however, it can be seen that transfer defects are prevented and yet the life of the belt is extended where the diameter of the end portions of the roller is smaller than that of the central portion by Φ3 mm.

In the case where a transfer brush is employed as the transfer member, different-length bristles are used between the central portion and end portions of the transfer brush, as shown in FIGS. 19A and 19B. With this structure, the pressure applied to the recording sheet P can be varied, depending upon the portions of the roller. In the experiment conducted by Applicants, 6 mm bristles were used in the central portion of the transfer roller (i.e., a 10 cm longitudinal portion in the center of the roller), and the height of the bristles was decreased from that central portion to the ends of the roller. The effects obtained with this structure were similar to those of the case where the transfer roller was employed. How the life of the transfer belt was when a transfer brush having different-length bristles was used is shown FIG. 20.

It should be noted that a transfer brush having bristles arranged at different densities between the central and end portions, such as the transfer brush shown in FIG. 21, produces similar effects to those of the transfer brush having different-length bristles. In the transfer brush shown in FIG. 21, the density of the bristles is higher in the central portion than in the end portions.

As described above, in the case where the pressure applied by the central portion of the transfer member and the pressure applied by the end portions thereof are different, the running life of the transfer belt can be extended, with satisfactory transfer characteristics maintained. In this case, images of high quality can be formed for a long period of time.

A description will now be given of the fourth embodiment of the present invention. The fourth embodiment also aims to extend the life of the transfer belt.

The surface layer of the transfer belt 11 are likely to be abraded at positions corresponding to the end portions of recording sheets P. One of the reasons for this is that the end portions of the recording sheets P strike the same surface portions of the belt again and again. Even if the recording sheets P of the same size are successively fed, their end portions can be prevented from striking the same portions of the belt by shifting the transfer belt 11 in the longitudinal direction of the photosensitive drum 2. By so doing, the life of the transfer belt 11 can be extended.

Figure 22:
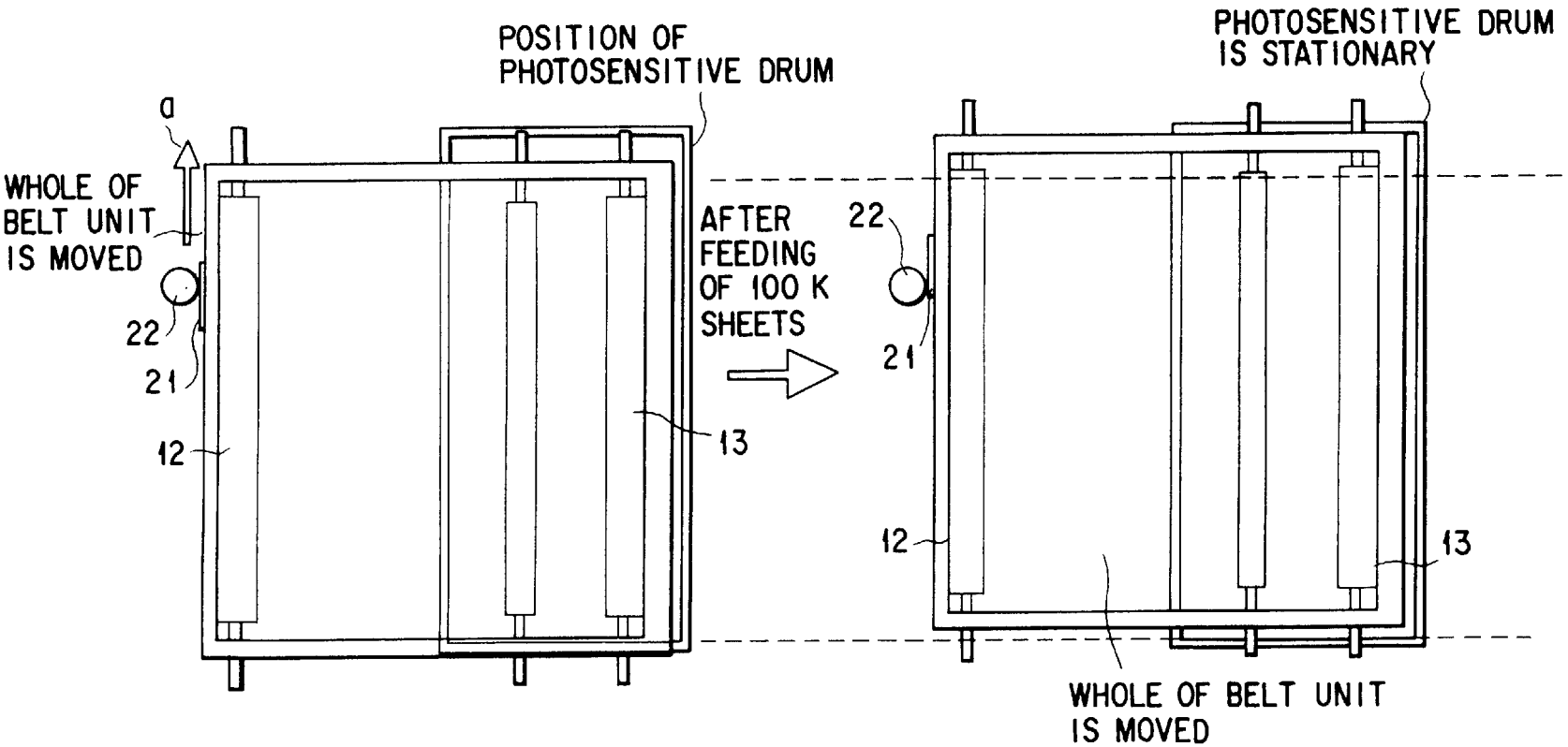
FIG. 22 is an illustration showing how a belt unit used for supporting the transfer belt is moved.

FIG. 22 schematically shows a structure which the fourth embodiment provides to shift the transfer belt 11 in the axial direction of the photosensitive drum 2. The transfer belt 11 is wound around both the driving roller 12 and the driven roller 13, and end portions of the these rollers coupled to a support member (not shown), thereby forming a belt unit. The support member is provided with a movement mechanism for gradually moving the belt unit in the axial direction of the photosensitive drum 2 in accordance with the running of the transfer belt 11. To be more specific, the movement mechanism comprises a rack 21 secured to the support member, and a pinion 22 rotated by a motor (not shown). The belt unit is moved by the motor in the direction indicated by arrow a in FIG. 22.

The belt unit moves in one direction for a distance of 10 mm or so, each time about 100×1000 paper sheets are fed. After moving in one direction for a distance of 10 mm, the belt unit moves in the opposite direction and comes back to the original position, with about 100×1000 paper sheets being fed in the meantime. This movement is repeated endlessly.

FIG. 23 shows how the belt unit was when it was moved under the above conditions. From FIG. 23, it can be understood that the life of the transfer belt 11 can be extended by the structure of the fourth embodiment. Where the belt unit is movable, the transfer belt 11 moves in the direction of arrow a even when an image forming operation is being executed. However, since the moving distance is 10 mm for 100×1000 sheets, it is 1 $\mu$m or less for one sheet. Accordingly, a defective image is not formed, nor is the recording sheet P conveyed in an unintended manner.

The advantages of the movable-belt unit system become more remarkable if the belt unit is kept stationary during execution of an image forming operation and is moved after a predetermined number of sheets have been printed. In the experiment conducted by Applicants, the belt unit was moved in one direction for a distance of 3 mm each time 100×1000 recording sheets were printed. In other words, the belt unit was moved for 15 mm when the printing operation for the 100×1000 recording sheets was repeated five times. In this case, the transfer belt 11 withstood the printing operation for 600×1000 sheets, without causing any wrinkles or lines at the end portions of the transfer belt 11.

According to the fourth embodiment, the transfer belt 11 is moved by moving the whole belt unit. Needless to say, however, similar advantages are produces by moving only the driving and driven rollers around which the transfer belt 11 is wound. Likewise, the conveyance path of recording sheets P may be shifted, with the belt unit fixed. In this case as well, similar advantages to those described above can be produced.

The present invention is not limited to any of the embodiments described above. When the invention is reduced to practice, the first to fourth embodiments described above can be combined in any manner. In other words, the present invention can be modified in various manners without departing from the spirit and scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a cylindrical image bearer rotatable in a predetermined direction;

an image formation unit for forming a visible image on a circumferential surface of the image bearer;

a transfer belt which is stretched between a pair of rollers located at a level lower than that of the image bearer and being away from each other in a horizontal direction and which is arranged in contact with the circumferential surface of the image bearer to define a conveyance nip, said transfer belt being made to run in a direction corresponding to a rotating direction of the image bearer and conveying a transfer medium through the conveyance nip;

a transfer roller arranged in the conveyance nip and kept in contact with a reverse side of the transfer belt to define a transfer nip, said transfer roller serving to transfer the visual image from the image bearer to the transfer medium which is conveyed through the conveyance nip; and an auxiliary unit for bringing that portion of the transfer belt which has passed through the transfer nip into contact with the circumferential surface of the image bearer, such that a a portion of the transfer belt which contacts the image bearer and has passed through the transfer nip is smaller in length than a portion of the transfer belt which is about to enter the transfer nip, and such that the portion of the transfer belt that contacts the image bearer and has passed through the transfer nip has a length of 1 mm or less.

2. An image forming apparatus according to claim 1, wherein said auxiliary unit guides that portion of the transfer belt which has passed through the transfer nip such that the portion of the transfer belt that contacts the image bearer and has passed through the transfer nip is zero in width.

3. An image forming apparatus according to claim 2, wherein said transfer roller is pressed against the reverse side of the transfer belt such that the transfer nip has a width of 2 mm or less.

4. An image forming apparatus according to claim 1, wherein said transfer roller is pressed against the reverse side of the transfer belt such that the transfer nip has a width of 2 mm or less.

5. An image forming method comprising the steps of:

forming a visible image on a circumferential surface of a cylindrical image bearer when the image bearer is being rotated in a predetermined direction;

driving a transfer belt to run in a direction corresponding to a rotating direction of the image bearer, said transfer belt being arranged in contact with the circumferential surface of the image bearer to define a conveyance nip;

conveying a transfer medium through the conveyance nip defined between the image bearer and the transfer belt; and transferring the visible image from the circumferential surface to the transfer medium conveyed through the conveyance nip by applying a bias to a transfer roller, said transfer roller being arranged in the conveyance nip and being kept in contact with a reverse side of the transfer belt, with a transfer nip defined, wherein that portion of the transfer belt which has passed through the transfer nip is brought into contact with the circumferential surface of the image bearer, and the transfer medium is guided in a tangential direction of the image bearer when that transfer medium has passed through the transfer nip, whereby a portion of the transfer belt that contacts the circumferential surface of the image bearer and which has passed through the transfer nip is smaller in length than a portion of the transfer belt that contacts the circumferential surface of the image bearer and that is about to enter the transfer nip.

* * * * *